US009398818B2

(12) United States Patent
Clark et al.

(10) Patent No.: US 9,398,818 B2
(45) Date of Patent: Jul. 26, 2016

(54) DISPLAY SYSTEM WITH SUSPENDED MERCHANDISE SUPPORT

(71) Applicant: TARGET BRANDS, INC., Minneapolis, MN (US)

(72) Inventors: Jeremy A. Clark, Minneapolis, MN (US); Michael A. Whittier, Minneapolis, MN (US); Scott Denby, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 662 days.

(21) Appl. No.: 13/785,362

(22) Filed: Mar. 5, 2013

(65) Prior Publication Data

US 2014/0252047 A1 Sep. 11, 2014

(51) Int. Cl.

| | |
|---|---|
| ***D06C 15/00*** | (2006.01) |
| ***A47F 5/10*** | (2006.01) |
| *A47F 8/00* | (2006.01) |

(52) U.S. Cl.

CPC ... *A47F 5/10* (2013.01); *A47F 8/00* (2013.01); *Y10T 29/49826* (2015.01)

(58) Field of Classification Search

CPC ..... A47F 5/10; A47F 8/00; A47G 25/32; A41H 5/00; A41H 5/01

USPC ..... 223/68, 120; 211/85.3; 248/122.1, 248/124.1, 125.1

See application file for complete search history.

(56) References Cited

U.S. PATENT DOCUMENTS

| | | | | | |
|---|---|---|---|---|---|
| 2,498,866 | A | * | 2/1950 | Suhajda | A41H 43/00 223/120 |
| 2,919,501 | A | * | 1/1960 | Settler | A47F 8/02 223/120 |
| 3,003,646 | A | | 10/1961 | Wolf | |
| 3,064,366 | A | | 11/1962 | Mullally | |
| 3,084,837 | A | | 4/1963 | Wolf | |
| 3,302,800 | A | * | 2/1967 | Zdanowski | B65D 85/185 206/291 |
| 3,323,657 | A | | 6/1967 | Robbins | |
| 3,430,775 | A | | 3/1969 | Fleischman | |
| 3,480,245 | A | * | 11/1969 | Gingher | A47G 25/32 211/113 |
| 3,627,143 | A | | 12/1971 | Alexander | |
| 4,196,813 | A | | 4/1980 | Cohen | |
| 4,204,601 | A | * | 5/1980 | Thomas | A47F 7/024 211/124 |
| 4,300,690 | A | * | 11/1981 | Thomas | A47F 7/024 211/124 |

(Continued)

*Primary Examiner* — Nathan Durham

(74) *Attorney, Agent, or Firm* — JoAnn M. Seaton; Griffiths & Seaton PLLC

(57) ABSTRACT

A merchandise display includes a stand and a hanger. The stand includes a base, a shaft extending upwardly from the base to a top end of the shaft, and an arm extending forwardly from the top end of the shaft. The arm defines a top, a bottom, a cavity open to the top and the bottom, and two notches extending downwardly from the top and being positioned on opposing sides of the cavity. The hanger includes an elongated column, an arm-coupling feature at a first end of the elongated column, and a device-coupling feature at a second end of the elongated column. The device-coupling feature is configured to be coupled with a merchandise support device, and the arm-coupling feature is partially received within and extends between the two notches of the arm such that the elongated column hangs through and below the cavity of the arm to the device-coupling feature.

20 Claims, 13 Drawing Sheets

(56) References Cited

U.S. PATENT DOCUMENTS

| | | | | | |
|---|---|---|---|---|---|
| 4,474,299 | A | | 10/1984 | Andrews | |
| 4,540,092 | A | | 9/1985 | DeSantis | |
| 4,739,911 | A | | 4/1988 | Quinn | |
| 4,792,071 | A | * | 12/1988 | Scarpa | A47G 25/0671 223/120 |
| 4,805,784 | A | | 2/1989 | Solheim et al. | |
| 5,152,404 | A | | 10/1992 | Salrin et al. | |
| 5,603,438 | A | * | 2/1997 | Jugan | A47G 25/16 223/85 |
| 5,647,492 | A | * | 7/1997 | Fillios | A47B 61/003 211/105.1 |
| 6,196,429 | B1 | | 3/2001 | Cavdek et al. | |
| 6,808,150 | B1 | | 10/2004 | Roetenberg | |
| 7,641,062 | B2 | | 1/2010 | Arakawa | |
| 7,900,385 | B2 | | 3/2011 | Clark et al. | |
| 7,959,018 | B2 | * | 6/2011 | Flickinger | A47F 7/06 211/30 |
| 8,540,087 | B1 | * | 9/2013 | Skaer | A47G 25/0685 211/100 |
| 2009/0283485 | A1 | | 11/2009 | Anderson | |
| 2013/0062300 | A1 | * | 3/2013 | Drake | A47B 57/34 211/183 |

* cited by examiner

DISPLAY SYSTEM WITH SUSPENDED MERCHANDISE SUPPORT

BACKGROUND OF THE INVENTION

Mannequins and other systems for displaying sample merchandise to consumers have long been used to both demonstrate how merchandise, such as clothing and/or accessories, will look during use and to entice consumers to purchase corresponding merchandise products. Mannequins generally require a lower structure for supporting the mannequins and therefore, often are not well adapted for use in small areas. In addition, the lower structures are often large enough to be distracting to the sample merchandise on display. Accordingly, a need for new sample merchandise displays continues to exist.

SUMMARY OF THE INVENTION

One aspect of the present invention relates to a merchandise display including a stand and a hanger. The stand includes a base, a shaft extending substantially vertically upwardly from the base to a top end of the shaft, and an arm extending forwardly from the top end of the shaft. The arm defines a top, a bottom, a cavity open to the top and the bottom, and two notches extending downwardly from the top. The two notches are positioned on opposing sides of the cavity opposite the shaft. The hanger includes an elongated column, an arm-coupling feature positioned at a first end of the elongated column, and a device-coupling feature positioned at a second end of the elongated column. The device-coupling feature is configured to be coupled with a merchandise support device, and the arm-coupling feature is at least partially received within and extends between the two notches of the arm such that the elongated column hangs through and below the cavity of the arm to the device-coupling feature. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Retailers continually strive to provide aesthetically pleasing and space effective means for promoting the sale of merchandise in their stores. This innovation provides a merchandise display system including a stand and a mannequin or other merchandise support member hanging from the stand. More specifically, the stand includes a vertical support member and an offset arm extending from a top portion thereof to form the stand in a substantially inverted L-shape. A hanger is selectively coupled with the merchandise support member and selectively hung from an end of the offset arm opposite the vertical support member. In one example, the hanger is hung from the offset arm by moving an arm interface portion of the hanger through a channel defined by the offset arm to a position above the offset arm, rotating the hanger about 90°, and lowering the arm interface portion into a notch or other seat near the end of the offset arm. The hanger extends from the notch through the channel to the merchandise support member positioned below the offset arm. In one example, the stand specifics further allow a plurality of merchandise display systems to be placed in close proximity to one another increasing the amount of merchandise that can be displayed over a given retail store footprint. Other advantages of the merchandise display system will be apparent to those of skill in the art upon reading this application.

Figure 1:
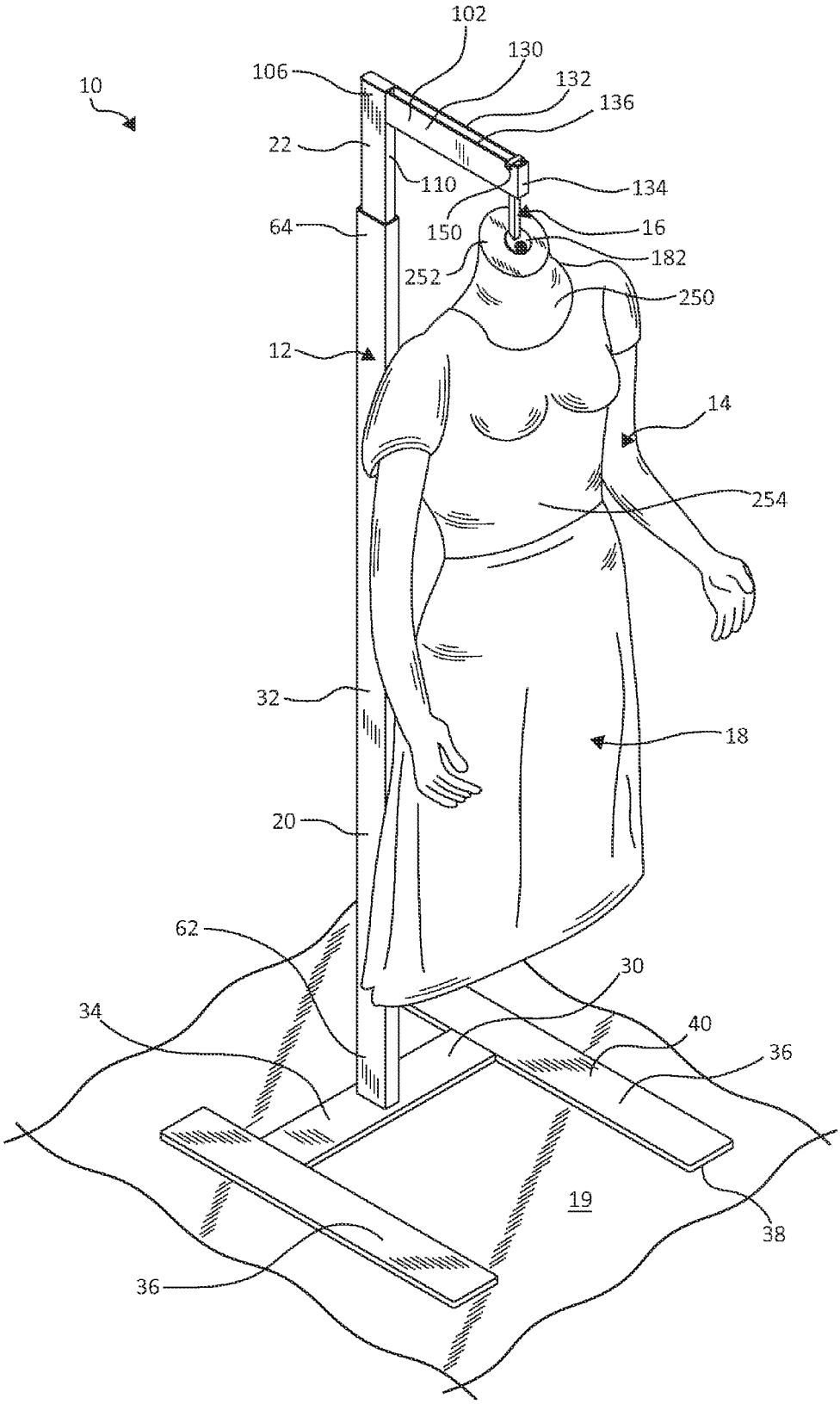
FIG. 1 is a front perspective view illustration of a merchandise display system, according to one embodiment of the present invention.
Figure 2:
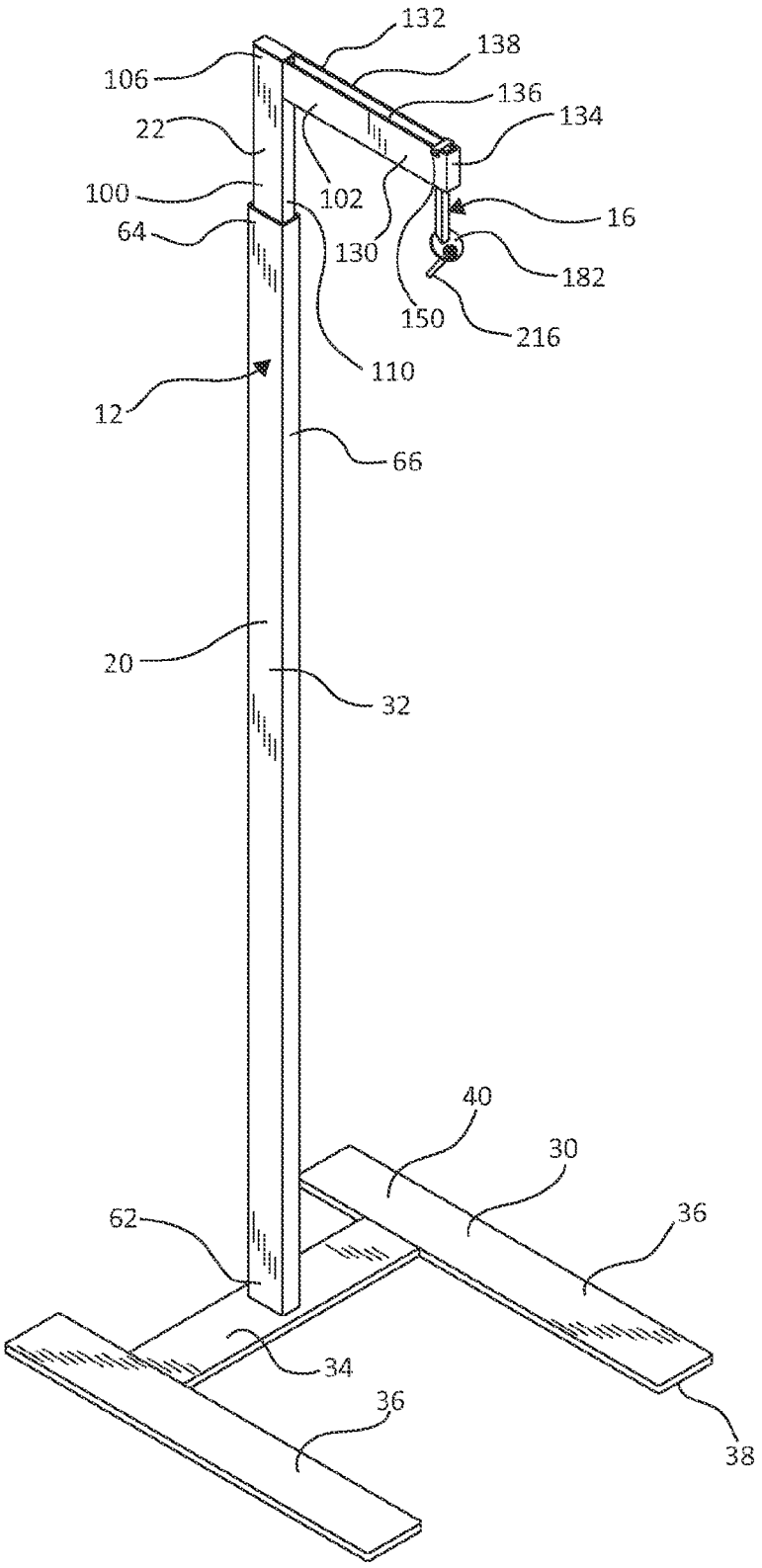
FIG. 2 is a front perspective view illustration of a stand of the merchandise display system of FIG. 1, according to one embodiment of the present invention.
Figure 3:
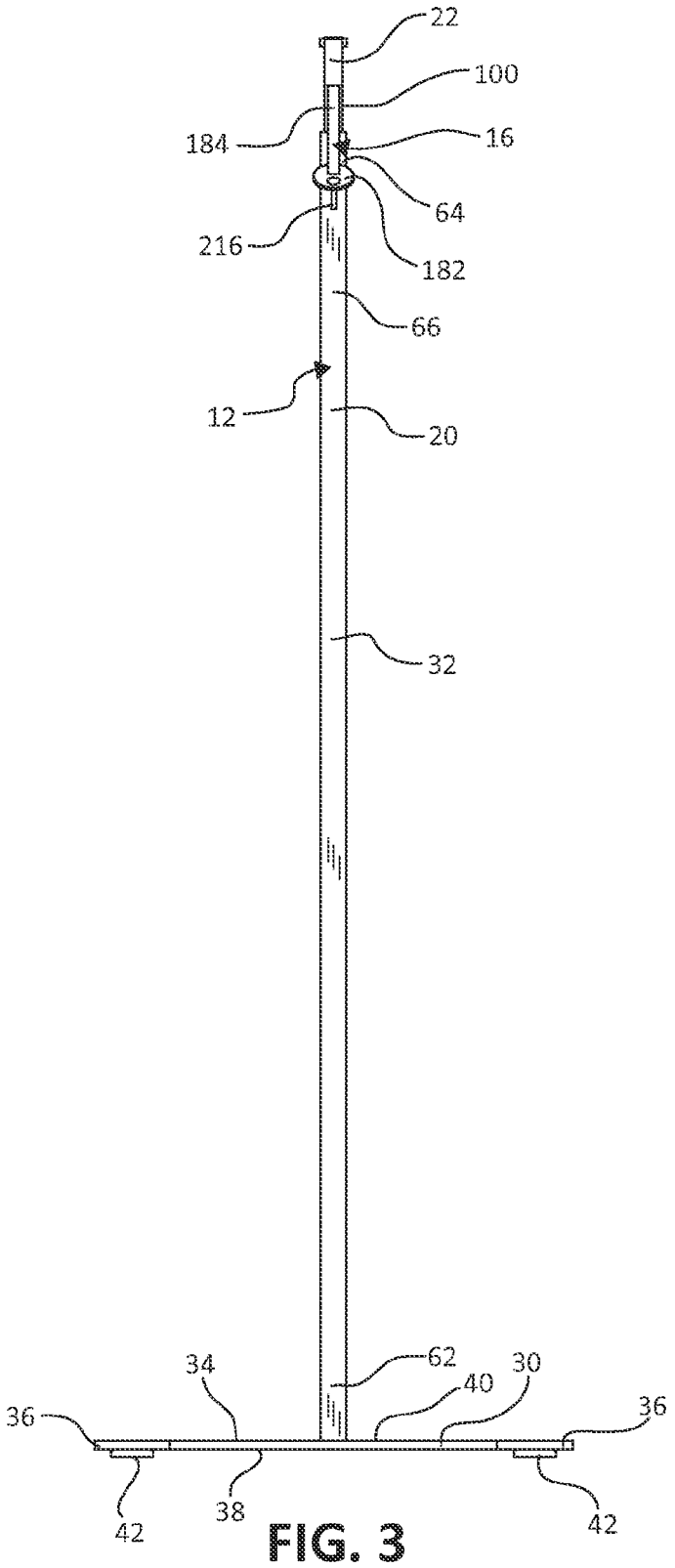
FIG. 3 is a front view illustration of the stand of FIG. 2, according to one embodiment of the present invention.
Figure 4:
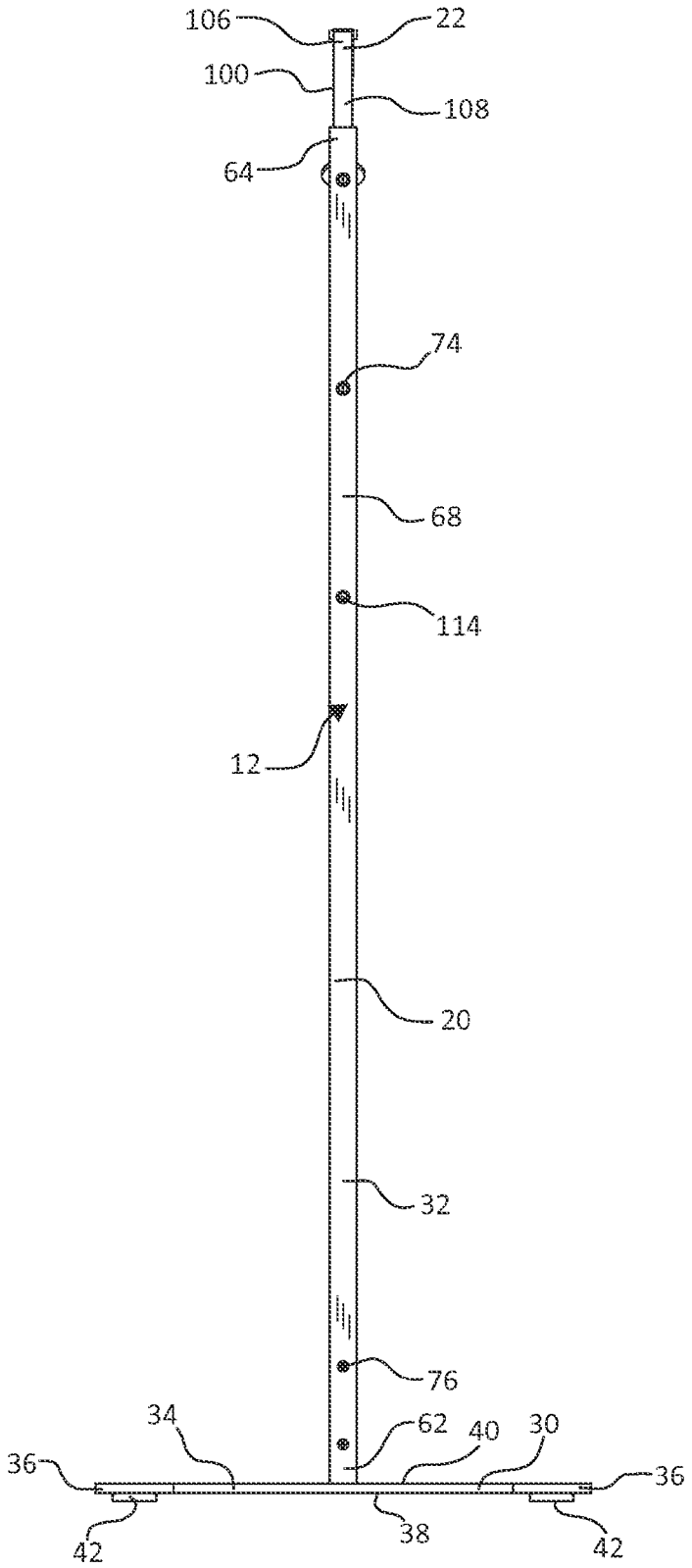
FIG. 4 is a rear view illustration of the stand of FIG. 2, according to one embodiment of the present invention.
Figure 5:
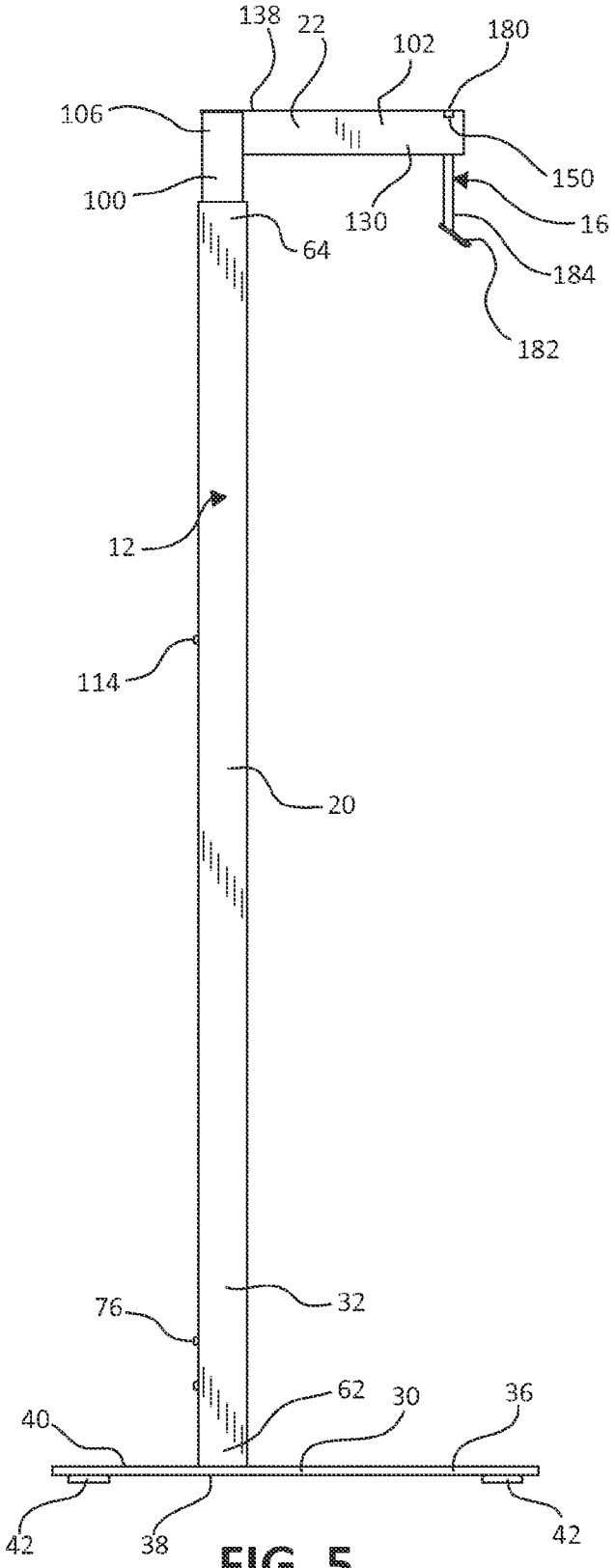
FIG. 5 is a left side view illustration of the stand of FIG. 2, according to one embodiment of the present invention.
Figure 6:
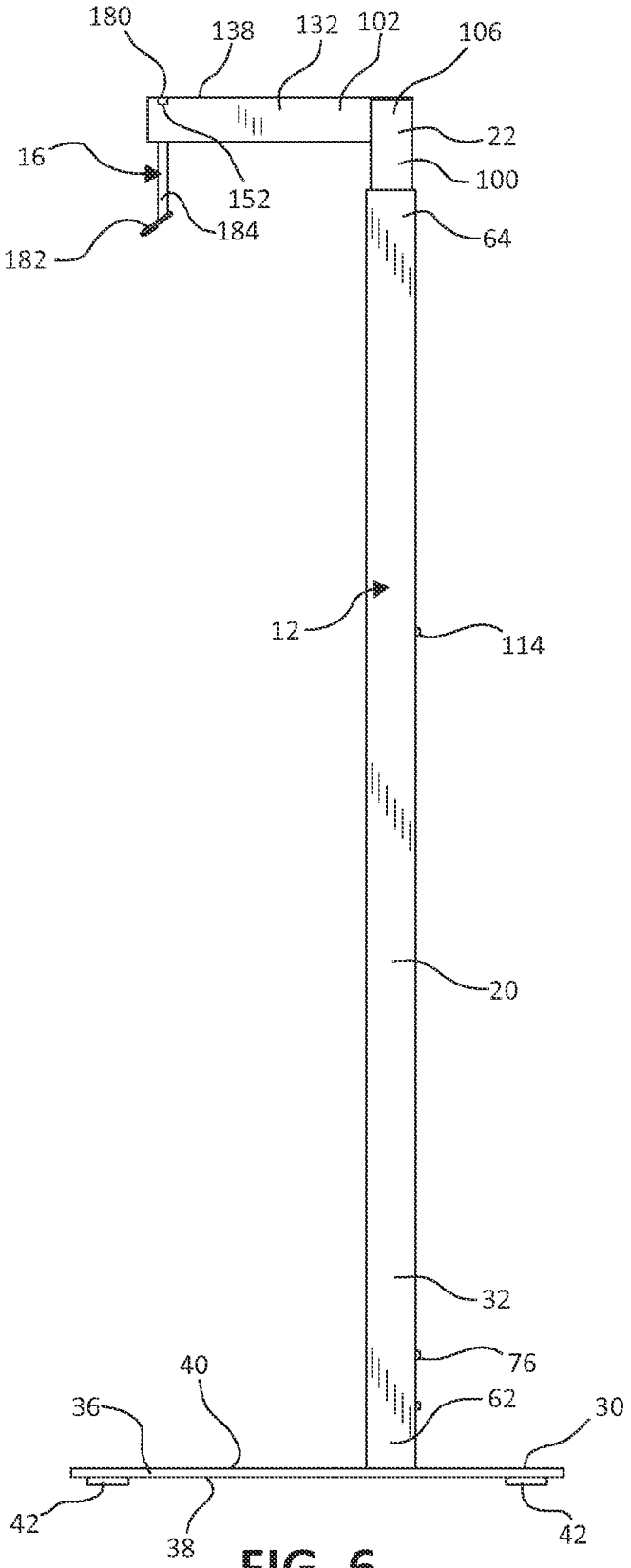
FIG. 6 is a right side view illustration of the stand of FIG. 2, according to one embodiment of the present invention.
Figure 7:
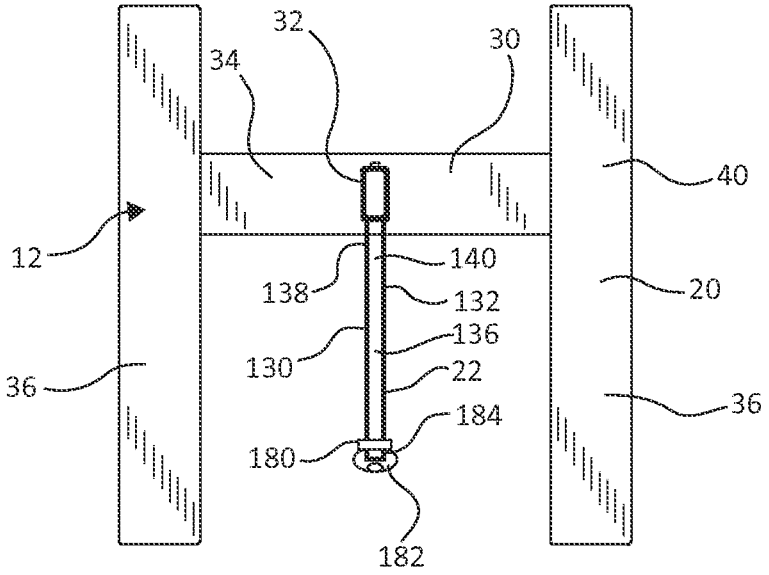
FIG. 7 is a top view illustration of the stand of FIG. 2, according to one embodiment of the present invention.

Turning to the Figures, FIG. 1 illustrates one embodiment of a merchandise display system 10 including a support or stand 12, a merchandise support member such as a mannequin 14, a suspended member such as a hanger 16, and retail products or merchandise 18. Stand 12 extends from a support surface 19 such as a floor or other display fixture substantially vertically upwardly. Hanger 16 is coupled with mannequin 14 and is selectively coupled with a top portion of stand 12 such that mannequin 14 hangs from stand 12 suspended above support surface 19. Merchandise 18, such as clothing, accessories, or any other suitable merchandise product, is placed on mannequin 14 such that merchandise 18 is displayed and maintained above support surface 19 suspended from stand 12. In one embodiment, stand 12 and hanger 16 collectively define a retail display fixture.

FIGS. 1-7 more specifically illustrate one embodiment of stand 12 with hanger 16. In one example, stand 12 includes a first or base section 20 and a second or extension section 22 as more clearly shown with additional references to the exploded view of stand 12 in FIG. 8. Base section 20 contacts support surface 19 and extends vertically therefrom, and extension section 22 extends from base section 20 a variable distance above and forwardly extending relative to base section 20. Hanger 16 is suspended from a portion of extension section 22 opposite base section 20.

Base section 20, according to the illustrated embodiments, includes base or platform 30 and a vertical support or trunk 32 extending upwardly therefrom. Base or platform 30 may take on any variety of configurations adapted to not only interface with support surface 19 (FIG. 1), but to also provide for a stable foundation from which a remainder of stand 12 extends. In one example, platform 30 is substantially H-shaped including a lateral member 34 extending between two substantially parallel and spaced apart longitudinal members 36, which are each substantially rectangularly shaped, plate-like members. Lateral member 34 is substantially centered relative to longitudinal members 36 front-to-back or rearwardly offset from a center of each of longitudinal members 36 to maintain weight of mannequin 14, etc., which hangs forwardly from trunk 32, in a more stable manner. Each of lateral member 34 and longitudinal members 36 is formed of wood, metal, composite, or other suitable material. In one instance, each of lateral member 34 and longitudinal members is formed of ⅜ inch stainless steel bar or plate material.

Lateral member 34 and longitudinal members 36 collectively define a bottom surface 38 and an opposite top surface 40 of platform 30. In one example, pads 42 are secured in four substantially corner positions of platform 30 to bottom surface 38 of platform 30. Pads 42 cushion the interface between platform 30 and support surface 19 (FIG. 1). In one embodiment, pads 42 alternatively or additionally are in the form of leveler disks or other structure that can be independently adjusted to account for an uneven support surface 19. In view of the above, platform 30 is one example of means for interacting with a support surface.

Platform 30 further includes a coupling post 50 extending upwardly from lateral member 34. For example, coupling post 50 is in the form of a channel (e.g., a three-sided channel) or tube although other specific configurations will be apparent to those of skill in the art. Coupling post 50 extends substantially vertically from a substantially lateral center of lateral ember 34. In one embodiment, a rear or other surface of coupling post 50 includes coupling apertures 52 for coupling with trunk 32, as will be further described below. Coupling post 50 extends from lateral member 34 a distance sufficient to provide for stable maintenance of trunk 32, and in one example extends about 4 inches to about 10 inches from lateral member 34, more particularly, about 6 inches from lateral member 34. Coupling post 50 is formed of any suitable substantially rigid material such as wood, metal, composite, etc., more particularly, of a stainless steel channel or tubular member.

Trunk 32 is a substantially elongated and vertically orientated member formed of any suitable substantially rigid material (such as wood, metal, composite, etc.) and shape (such as a channel, two channels welded together, tube, etc.) defining and extending between a first end 62 and a second end 64 opposite first end 62. In one example, trunk 32 has a height of between about two feet and about five feet, for instance, about four feet and four inches. Other suitable heights will be apparent to those of skill in the art upon reading this application based on the desired end use and environment for stand 12. Trunk 32, according to one example, has a substantially rectangular cross-sectional shape and defines a front surface 66, a rear surface 68 opposite front surface 66, and a cavity 70 extending throughout a substantially entirety of the trunk 32 and formed between front surface 66 and rear surface 68.

Figure 8:
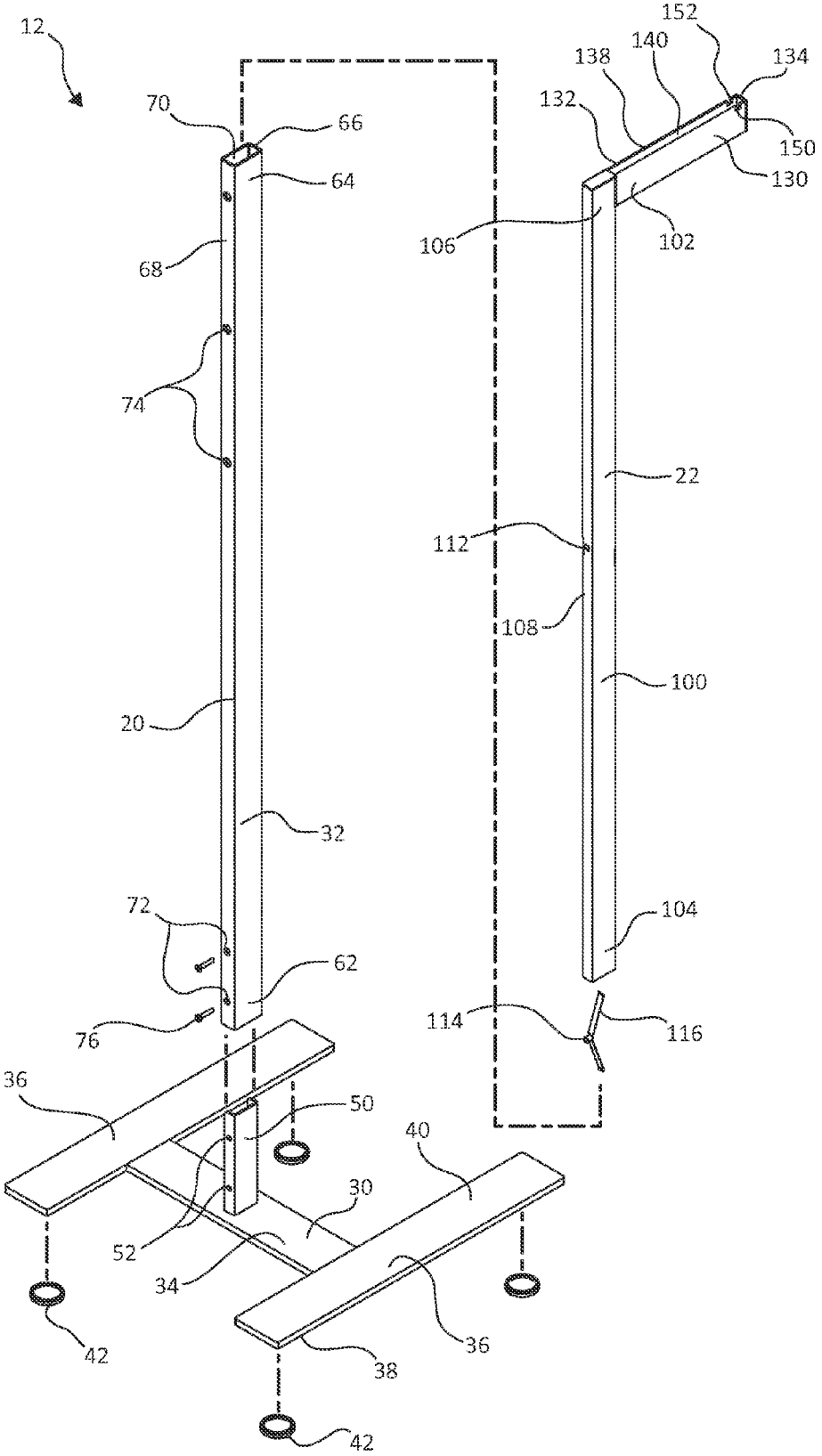
FIG. 8 is an exploded, rear perspective view illustration of the stand of FIG. 2, according to one embodiment of the present invention.

In one example, coupling post 50 of platform 30 is sized to fit within cavity 70 near first end 62, for instance with a substantially identical overall shape with slightly smaller dimensions than the inside dimensions of cavity 70. Accordingly, trunk 32 defines base coupling apertures 72 positioned near first end 62 of trunk 32 to align with apertures 52 of coupling post 50 and to each receive a corresponding fastener 76 as best shown in FIG. 8, according to the illustrated embodiment. Rear surface 68 or other portion of trunk 32 additionally defines two or more extension section coupling apertures 74 extending therethrough nearer second end 64 than first end 62 of trunk 32. Each of the extension section coupling apertures 74 is used to maintain a different overall height of extension section 22 and stand 12 as a whole, as will be further described below.

Extension section 22 is configured to partially fit within cavity 70 of trunk 32 in a telescoping manner, such that a height that extension section 22 extends out of trunk 32 is adjustable. In one embodiment, extension section 22 includes an elongated stem or shaft 100 and a branch member or arm 102. Shaft 100 defines and extends between a first end 104 and a second end 106 opposite first end 104 and has an outer shape substantially identical to a shape of, but sized slightly smaller than, cavity 70 of trunk 32. Shaft 100 is substantially elongated and formed of any suitable material sized and shaped to be of sufficient rigidity to maintain its form and structural integrity when mannequin 14 is supported therefrom, as will be further described below. In one example, shaft 100 is formed of wood, metal (e.g., stainless steel tubing or welded channels, etc.), or other suitable material.

In one embodiment, shaft 100 defines a rear surface 108 and a front surface 110 opposite rear surface 108. Shaft 100 is at least partially hollow such that a cavity (not shown) is formed therethrough between rear surface 108 and front surface 110. Rear surface 108 defines an aperture 112, e.g., about mid way along a height of shaft 100. A pin 114 with biasing spring members 116 attached thereto, for example, extending in opposing directions therefrom, is positioned within the cavity in shaft 100 such that pin 114 extends from the cavity and out aperture 112. Spring members 116 interact with internal surfaces (not shown) of shaft 100 to bias pin 114 to extend through and out of aperture 112 when any force pushing pin 114 into the cavity of shaft 100 is removed. In one example, pin 114 is sized with a diameter or other outer dimension less than a size of apertures 74 defined by trunk 32.

Figure 9:
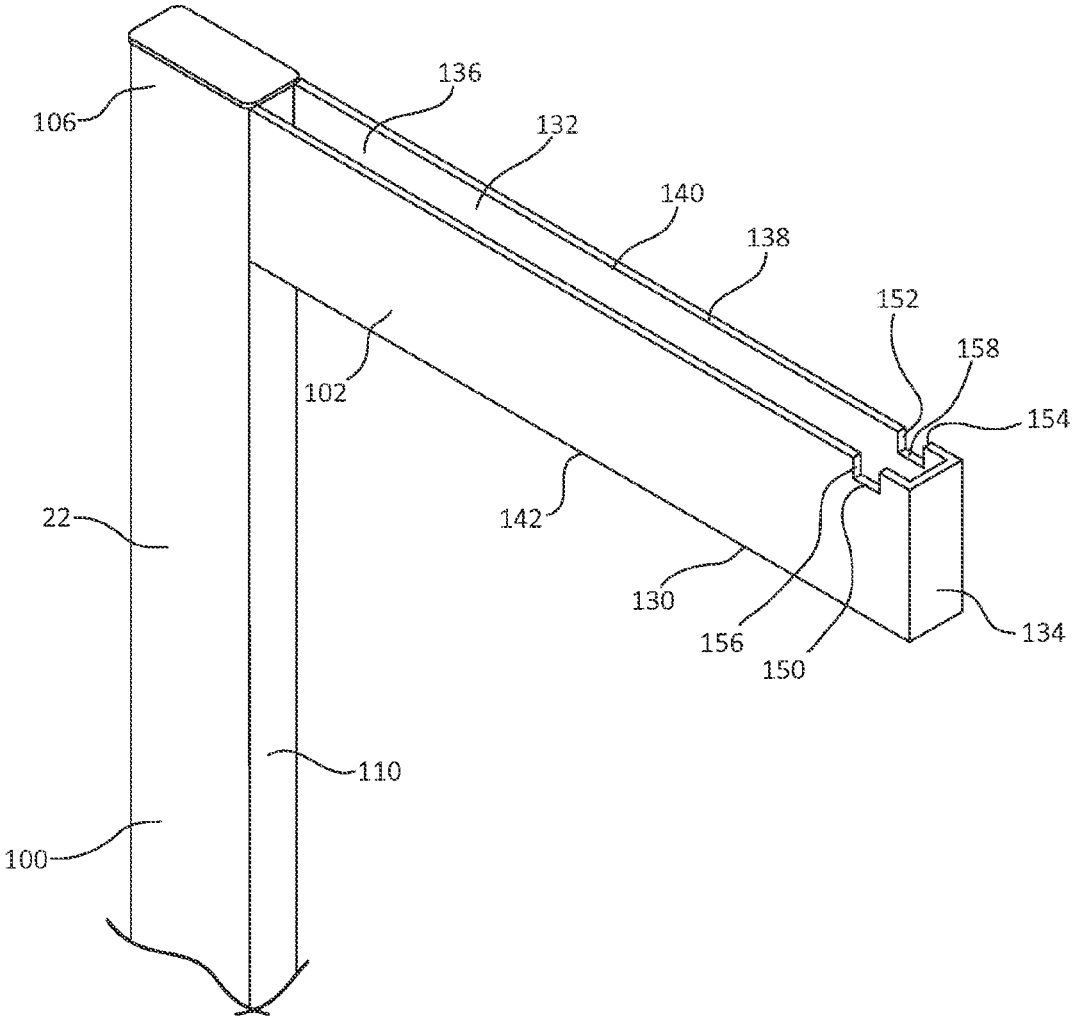
FIG. 9 is a partial, front perspective view illustration of an extension section of the stand of FIG. 2, according to one embodiment of the present invention.
Figure 12:
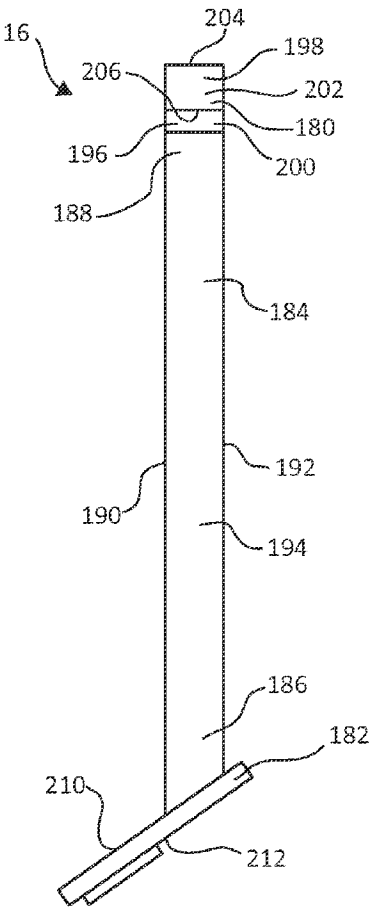
FIG. 12 is a right side view illustration of the hanger of FIG. 10, according to one embodiment of the present invention.

Arm 102 extends forwardly from, for example, substantially perpendicularly relative to, second end 106 of elongated shaft 100 to a front end, for example, a front end capped by front plate 134. Additionally referring to FIG. 9, in one embodiment, arm 102 is formed of two substantially parallel side plates 130 and 132 each extending from elongated shaft 100 to front plate 134. Side plates 130 and 132 are spaced from each other in a transverse direction such that an open chamber or channel 136 is formed therebetween. In one example, each of side plates 130 and 132 defines a top edge 138 and a bottom edge 142 opposite top edge 138. Top edges 138 collectively define a top opening 140 to channel 136, where, in one instance, top opening 140 extends along a substantial entirety of a length of arm 102. Bottom edges 142 collectively define a bottom opening (not shown) to channel 136, where, in one instance, the bottom opening extends along a substantial entirety of the length of arm 102. In one embodiment, each of side plates 130 and 132 is positioned to be substantially entirely within a different vertical plane parallel to the other one of side plates 130 and 132 such that the bottom opening is substantially identical to and alighted with top opening 140. Although primarily disclosed as including two spaced apart side plates 130 and 132, in other examples, arm 102 is otherwise formed to be elongated and includes a channel or other opening extending from the bottom surface of arm 102 through a top surface of the arm 102 to and beyond top edges 138, as will be apparent to those of skill in the art after reading this application in its entirety.

Each side plate 130 and 132 defines a notch 150 and 152, respectively, or other hanger-seating feature near front plate 134 of arm 102. As illustrated, in one embodiment, notches 150 and 152 are substantially identical to and extend downwardly from top edge 138 of each respective plate 130 and 132. More particularly, each of notches 150 and 152 defines a front edge 152, a rear edge 156, and a bottom edge 158. Front edge 152 and rear edge 156 each extend from a respective top edge 138 toward a respective bottom edge 142 of either of side plates 130 and 132, for example, such that front edge 152 and rear edge 156 extend substantially parallel to one another. Bottom edge 158 extends from front edge 152 to rear edge 156, for example, in a direction substantially parallel to one or both of top edge 138 and bottom edge 142, forming each notch 150 and 152 as a polygon, such as a square or rectangle (as illustrated), a triangle, or other suitable shape. Notches 150 and 152 are each positioned a substantially identical distance away from front plate 134 such that notches 150 and 152 are aligned to each receive a portion of hanger 16 as will be further described below.

Continuing to refer to FIG. 8, stand 12 is assembled by placing a first end of trunk 32 over coupling post 50 of base 30. In one example, first end of trunk 32 further interfaces with or abuts top surface 40 of lateral member 34 around coupling post 50 and/or is secured to coupling post 50 via fasteners 76 extending through apertures 72 in trunk 32 and apertures 52 in coupling post 50. As a result, trunk 32 extends from base 30 with a similar orientation as coupling post 50 extends from base, for example, in a substantially vertical orientation.

Extension section 22 is subsequently coupled with base section 20, in one embodiment, by sliding shaft 100 of extension section 22 into cavity 70 of trunk 32 from the second end 64 of trunk 32. A distance that extension section 22 extends into and extends out of trunk 32 (and, therefore, extends above base 30 and/or support surface 19) is adjustable, for example, by vertically moving shaft 100 relative to trunk 32 until pin 112 aligns with and extends through one of apertures 74 to selectively maintain the desired height of extension section 22. Pin 112 can be depressed to overcome the force of spring members 116 and move pin 112 out of the one of apertures 74 once again allowing extension section 22 to be vertically adjusted to align pin 112 with another one of apertures 74. Upon assembly of stand 12, arm 102 extends forwardly from, for instance, substantially perpendicularly from, the substantially vertical portion of stand 12 collectively defined by trunk 32 and shaft 100. In view of the above, trunk 32, shaft 100, or the combination of trunk 32 and shaft 100 are examples of means for extending upwardly from platform 30, and arm 102 is one example of means for extending forwardly from trunk 32, shaft 100, or the combination of trunk 32 and shaft 100.

Figure 11:
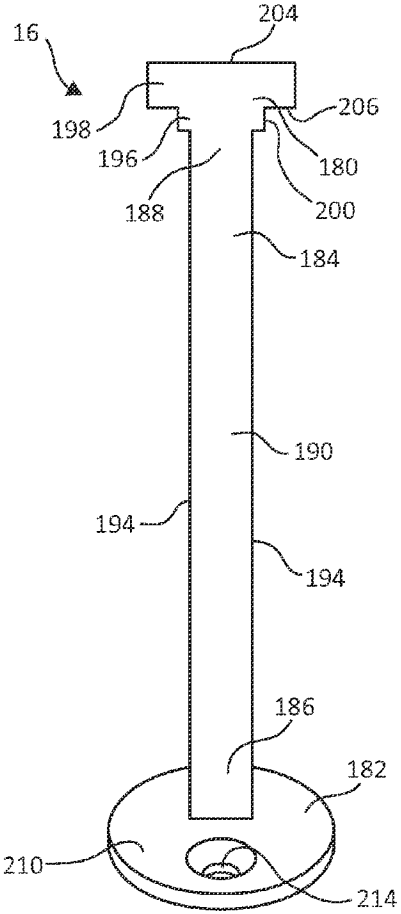
FIG. 11 is a front view illustration of the hanger of FIG. 10, according to one embodiment of the present invention.
Figure 10:
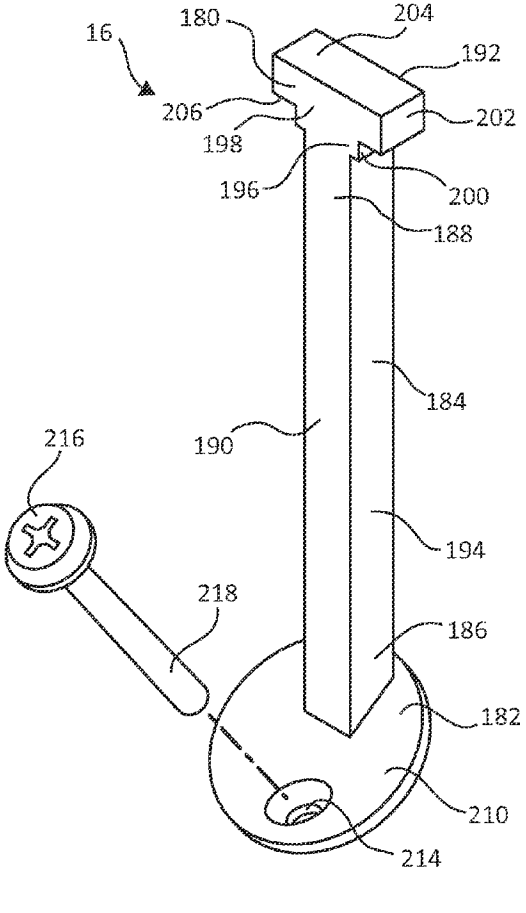
FIG. 10 is a front perspective view illustration of a hanger and a locking assembly of the merchandise display system of FIG. 1, according to one embodiment of the present invention.

Hanger 16 can be formed in a variety of configurations and includes an arm-coupling feature 180 spaced from a mannequin-coupling feature or plate 182. As shown in FIGS. 10 and 11, in one embodiment, hanger 16 includes an elongated column 184 extending between mannequin-coupling plate 182 coupled to a first end 186 of elongated column 184 and arm-coupling feature 180 coupled to an opposite and second end 188 of elongated column 184. In one example, arm-coupling feature 180 is formed as a single piece is of metal or other suitable material with elongated column 184 such that arm-coupling feature 180 and elongated column 184 collectively define a substantially planar front surface 190 and an opposite and substantially planar rear surface 192. A primary thickness of hanger 16 defined between front surface 190 and rear surface 192. In one example, the primary thickness of hanger 16 is less than a transverse width of channel 136 and is substantially identical to, but slightly less than, a distance between front edge 154 and rear edge 156 of notches 150 and 152 of arm 102. In the illustrated embodiments, elongated column 184 has a substantially square or rectangular cross-section forming opposing side surfaces 194, which extend between front surface 190 and rear surface 192. Other cross-sectional shapes of elongated column 184 are also contemplated.

Arm-coupling feature 180 includes a first transverse segment 196 extending across second end 188 of elongated column 184 and extending beyond each of opposing side surfaces 194 to define opposing side surfaces 200 of first transverse segment 196. A width of first transverse segment 196 is defined between opposing side surfaces 200 that is greater than a width of elongated column 184. A second transverse segment 198 of arm-coupling plate 182 is immediately adjacent to first transverse segment 196 and extends across a top of first transverse segment 196 and beyond each of opposing side surfaces 200 of first transverse segment 196 and to define opposing side surfaces 202 of second transverse segment 198. In one example, corresponding side surfaces 194, 200, and 202 are collectively formed in a stepped configuration such that second transverse segment 198 defines a largest width of hanger 16 between its side surfaces 202. Accordingly, a width of second transverse segment 198 defined between opposing side surface 202 is greater than the width of first transverse segment 196. Second transverse segment 198 additionally defines a top surface 204 (e.g., a topmost surface) of hanger 16 and an opposite bottom surface 206 extending transversely beyond opposing side surfaces 200 of first transverse segment 196. In this manner, arm-coupling feature 180 and elongated column 184 collectively define a stepped, T-shape in one embodiment. In one example, each of elongated column 184, first transverse segment 196, and second transverse segment 198 all have a substantially identical thickness measured between front surface 190 and rear surface 192. Per the illustrated embodiment, each of elongated column 184, first transverse segment 196, and second transverse segment 198 partially define each of front surface 190 and rear surface 192, and front surface 190 and rear surface 192 are each substantially planar.

Mannequin-coupling plate 182 is configured to be coupled with mannequin 14 or other merchandise support devices, for example, to a top surface 252 of mannequin 14. Accordingly, mannequin-coupling plate 182 is angled or otherwise formed to securely mate with or follow along top surface 252 of mannequin 14. In the illustrated embodiment, for example, top surface 252 of mannequin 14, for instance, top surface 252 of mannequin 14 forming a neck cap of mannequin 14, is angled downwardly and forwardly. Accordingly, first end 186 of elongated column 184 is angled to couple with and hold mannequin-coupling plate 182 at the desired angle to correspond with top surface 252 of mannequin 14. More specifically, first edge 186 of elongated column 184 couples to, e.g., directly to, top surface 210 of mannequin-coupling plate 182. In one example, mannequin-coupling plate 182 defines an aperture 214 extending from top surface 210 through mannequin-coupling plate 182 to a bottom surface 212 opposite top surface 210. A locking component 216 or other coupling device, for example, a pin 218 thereof, extends through aperture 214 to engage and couple with mannequin 14, thereby, securing mannequin 14 to hanger 16. In this manner, hanger 16 can be specifically configured to receive a number of different mannequins 14 as will be apparent to one of skill in the art upon reading this application in its entirety. In view of the above and below disclosure, hanger 16 is means for supporting a merchandise display structure such as mannequin 14.

In establishing a merchandise display system 10, stand 12 is positioned in a retail setting or other suitable environment in or close to a desired end position within the retail setting. For example, platform 30 is placed on a desired support surface 19 such as near corresponding merchandise (not shown) offered for retail sale. A position of extension section 22 relative to base section 20 maybe adjusted to a desired height by pressing pin 114 inwardly to release pin 114 from a current one of apertures 74 and sliding shaft 100 further into or out of cavity 70 of trunk 32 until pin 114 aligns with another one of apertures 74 and is pushed outwardly therethrough due to biasing spring members 116.

Figure 14:
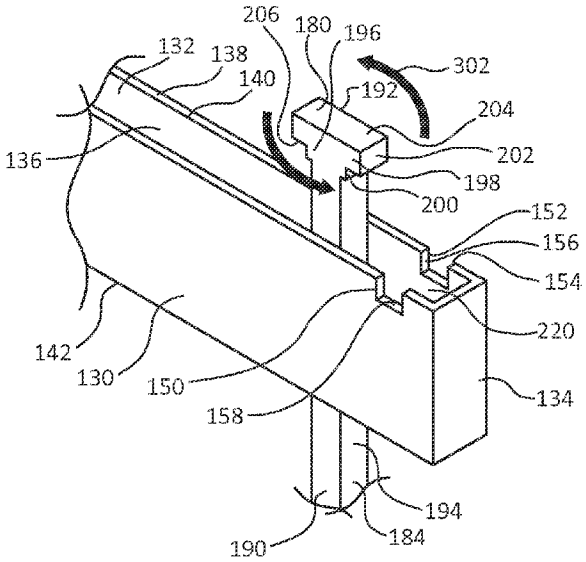
FIG. 14 is a partial, front perspective view illustration of a second operation in the assembly of the hanger of FIG. 11 with the stand of FIG. 2, according to one embodiment of the present invention.
Figure 13:
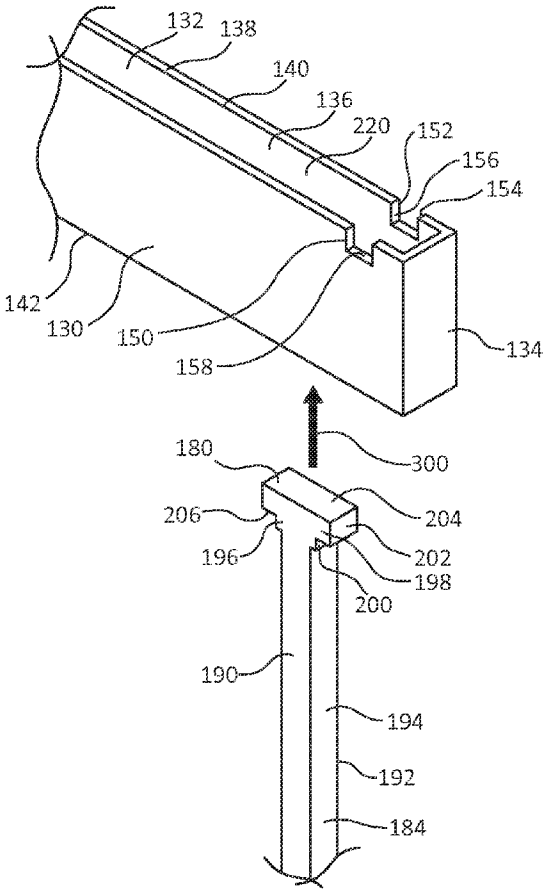
FIG. 13 is a partial, front perspective view illustration of a first operation in an assembly of the hanger of FIG. 11 with the stand of FIG. 2, according to one embodiment of the present invention.

Mannequin 14, which has previously been coupled to hanger 16 via locking component 216 or other suitable means, is hung from stand 12. More specifically, referring to FIG. 1 and FIGS. 13-16, mannequin 14 is lifted toward arm 102 of stand 12 and is rotated about 90° (i.e., a quarter turn) from its front facing position (e.g., a front facing position as illustrated in FIG. 1) either clockwise (as indicated in the FIGS. 13 and 14) or counterclockwise to turn hanger 16. Upon turning hanger 16, first and second transverse segments 196 and 198 extend front to back and align with elongated bottom opening (not shown) of channel 136 formed between side plates 130 and 132. Once hanger 16 is aligned with arm 102, mannequin 14 is moved upwardly toward arm 102 in a manner also moving hanger 16 upwardly, through channel 136, through top opening 140 of channel 36, and to position each of first and second transverse segments 196 and 198 fully above top edges 138 of side plates 130 and 132, as illustrated in FIG. 14.

Notably, elongated column 184 is sized to define a width and length that are each not only less than a transverse width of channel 136, but that also allow elongated column 184 to be rotated about its elongated center axis while elongated column 184 is positioned within channel 136. As indicated by arrows 302 in FIG. 14, mannequin 14 and hanger 16 are rotated back to a forward facing position, for example, about 90° counterclockwise. In this position, hanger 16 is not readily able to move through channel 136 since at least second transverse segment 198 has a width that is larger than the width of channel 136 and, in one example, larger than an overall width of arm 102.

Figure 16:
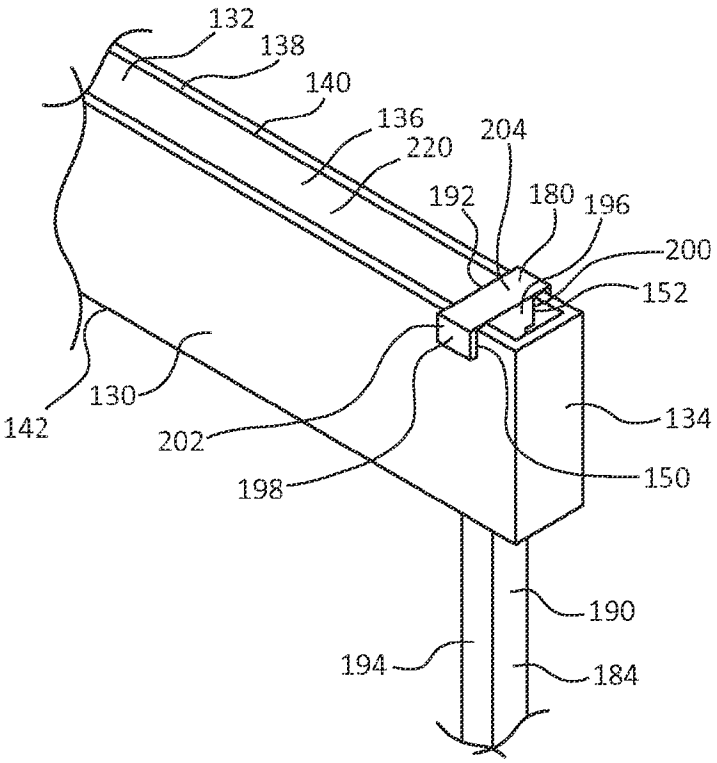
FIG. 16 is a partial, front perspective view illustration of a fourth operation in the assembly of the hanger of FIG. 11 with the stand of FIG. 2, according to one embodiment of the present invention.
Figure 15:
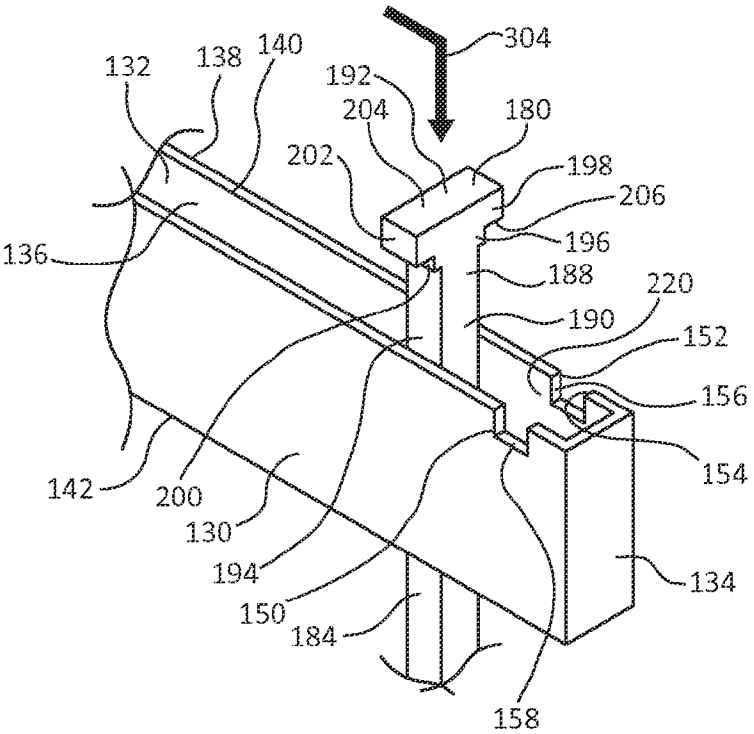
FIG. 15 is a partial, front perspective view illustration of a third operation in the assembly of the hanger of FIG. 11 with the stand of FIG. 2, according to one embodiment of the present invention.

From this position, mannequin 14 is pulled forwardly and downwardly as indicated by arrow 304 in FIG. 15 to position second transverse segment 198 of hanger 16 in notches 150 and 152 of arm 102 as illustrated in FIG. 16. More specifically, first moving hanger 16 forwardly along arrow 304 moves hanger 16 to align second transverse segment 198 with each of notches 150 and 152 of arm 102. Subsequently, moving hanger 16 downwardly, also per arrow 304, positions second transverse segment 198 within each of and extending between each of notches 150 and 152. When second transverse segment 198 is seated in notches 150 and 152, notches 150 and 152 are substantially filled such that portions of front and rear surfaces 190 and 192 that are defined by second transverse segment 198 contact or very nearly each contact front edges 154 and rear edges 156 of notches 150 and 152 to maintain hanger 16 in a substantially vertical orientation, or other orientation dictated by a corresponding orientation of notches 150 and 152. In one example, a width of first transverse segment 196 is substantially equal to the inside width of channel 136 such that, when second transverse segment 198 is in notches 150 and 152, opposing side edges 200 of first transverse segment 196 contact or nearly contact inside surfaces 220 (FIGS. 13-16) to provide additional rotational stability to the coupling of hanger 16 and arm 102.

Figure 17:
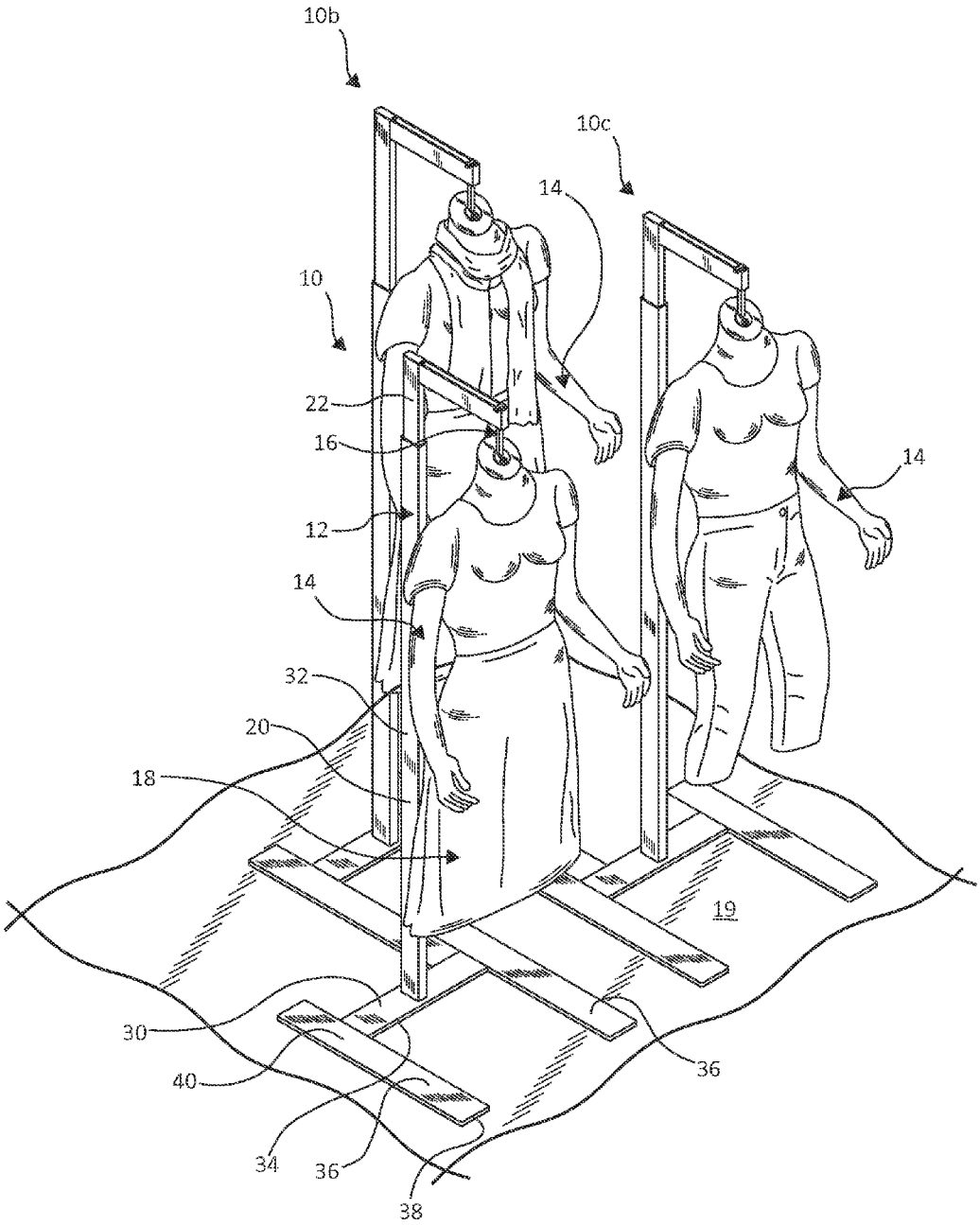
FIG. 17 is a front, perspective view illustration of merchandise display including a plurality of merchandise display systems, according to one embodiment of the present invention.

When hanger 16, more particularly, second transverse segment 196, is seated in notches 150 and 152, hanger 16 hangs from arm 102 of stand 12 supporting suspended mannequin 14 therefrom. In one embodiment, mannequin 14 hangs from stand 12 with no additional support being provided mannequin 14. Mannequin 14, more specifically, a body 250 of mannequin 14 generally is dressed in merchandise or retail items 254 before or after mannequin 14 is hung from stand 12. Retail items 254 generally correspond with similar retail items being offered for sale near to mannequin 14. In one example, a plurality of mannequins 14 hung from substantially identical stands 10, 10*b*, and 10*c* are positioned near each other as illustrated, for example, in FIG. 17 to form a larger overall merchandise display. Stands 10, 10*b*, and 10*c* may be adjusted to various heights to increase aesthetic appeal of the overall merchandise display, for instance, as illustrated in FIG. 17 with a back stand 10*b* having extension section 22 extending further above base section 20. In one example, the substantial H-shape of platforms 30 allows one or more longitudinal member 36 of one stand 10, 10*b*, and 10*c* to be positioned between one or more longitudinal member 36 of another stand 10, 10*b*, and 10*c* to decrease the overall footprint of retail support surface 19 used to support stands 10, 10*b*, and 10*c* and, thereby, providing additional advantages to the retailer.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A merchandise display comprising:

a stand comprising a base, a shaft extending substantially vertically upwardly from the base to a top end of the shaft, and an arm extending forwardly from the top end of the shaft, wherein:

the arm defines a top, a bottom, a cavity open to the top and the bottom, and two notches extending downwardly from the top, and the two notches are positioned on opposing sides of the cavity and opposite the shaft; and a hanger comprising an elongated column, an arm-coupling feature positioned at a first end of the elongated column, and a device-coupling feature positioned at a second end of the elongated column;

wherein:

the device-coupling feature is configured to be coupled with a merchandise support device, the arm-coupling feature is at least partially received within and extends between the two notches of the arm such that the elongated column hangs through and below the cavity of the arm to the device-coupling feature, the elongated column defines opposing side surfaces, the arm-coupling feature includes:

a first transverse segment extending across and beyond the opposing side surfaces of the elongated column to define two opposing side surfaces of the first transverse segment, and a second transverse segment extending across and beyond the two opposing side surfaces of the first transverse segment, the first transverse segment being positioned adjacent to each of and between the first end of the elongated column and the second transverse segment.

2. The merchandise display of claim 1, wherein:

the arm includes two opposing side panels extending substantially parallel to one another, each of the two opposing side panels extends from the shaft to a front end of the arm, the cavity is formed between the two opposing side panels, and each of the two opposing side panels defines a different one of the two notches.

3. The merchandise display of claim 2, wherein each of the two opposing side panels is substantially planar and extends substantially unsupported between the shaft and the front end of the arm.

4. The merchandise display of claim 1, wherein:

each of the two notches has a notch shape and a notch size, the arm-coupling feature includes a segment defining opposing ends each having a cross-sectional segment shape and a segment size, the cross-sectional segment shape and the segment size are substantially identical to the notch shape and the notch size, respectively, such that each of the opposing ends of the segment extends through and fits tightly within a different one of the two notches.

5. The merchandise display of claim 4, wherein the notch shape is a rectangle.

6. The merchandise display of claim 1, wherein the arm-coupling feature and the elongated column each have overall outside dimensions smaller than overall outside dimensions of the cavity such that the arm-coupling feature can be moved from the bottom of the arm, through the cavity, and above the top of the arm, and the elongated column can be rotated about an elongated axis of the elongated column within the cavity.

7. The merchandise display of claim 6, wherein:

the arm-coupling feature is sized such that the arm-coupling feature can be moved from the bottom of the arm, through the cavity, and above the top of the arm only when the hanger is in a first orientation, and the arm-coupling feature is at least partially received within and extends between the two notches only when the hanger is rotated about a quarter turn from the first orientation to a second orientation.

8. The merchandise display of claim 1, wherein:

the elongated column, the first transverse segment, and the second transverse segment collectively define front and back surfaces of the hanger, and the front and back surfaces of the hanger are substantially planar.

9. The merchandise display of claim 1, wherein portions of the second transverse segment extending beyond the two opposing side surfaces of the first transverse segment are received within the two notches.

10. The merchandise display of claim 9, wherein:

the first transverse segment defines a width between the two opposing side surfaces of the first transverse segment, and the width of the first transverse segment is substantially equal to a width of the cavity.

11. The merchandise display of claim 10, wherein the elongated column, the first transverse segment, and the second transverse segment are formed as a single piece of material.

12. The merchandise display of claim 10, wherein:

the arm defines two opposing interior surfaces each facing the cavity, and the two opposing side surfaces of the first transverse segment are each positioned adjacent a different one of the two opposing interior surfaces of the arm.

13. The merchandise display of claim 10, wherein the second transverse segment defines a top surface positioned to be substantially coplanar with the top of the arm.

14. The merchandise display of claim 1, wherein:

the base defines a platform and a trunk extending substantially vertically upwardly from the platform, and the shaft is telescopically received within the trunk.

15. The merchandise display of claim 14, wherein:

the trunk includes a plurality of apertures, and the shaft includes a biased pin extending outwardly therefrom to selectively interact with different ones of the plurality of apertures to selectively change a height that the shaft extends above the platform.

16. The merchandise display of claim 1, further comprising the merchandise support device coupled to the device-coupling feature.

17. The merchandise display of claim 16, wherein the merchandise support device is a mannequin.

18. The merchandise display of claim 17, further comprising merchandise displayed on the mannequin.

19. The merchandise display of claim 1, wherein:

the device coupling feature includes a coupling plate extending with an angled orientation relative to the elongated column and configured to be coupled with a neck cap of a mannequin, and a locking component extends through the coupling plate and is configured to extend into the neck cap of the mannequin to couple the hanger with the mannequin.

20. A retail display fixture comprising:

means for interacting with a support surface;

means for extending upwardly from the means for interacting;

means for extending forwardly from the means for extending upwardly, wherein the means for extending forwardly defines a top and a bottom and includes a channel, which extends therethrough and is open to each of the top and the bottom of the means for extending forwardly, and two notches, which extend downwardly from top edges of the means for extending forwardly on either side of the channel; and means for supporting a merchandise display structure, the means for supporting including:

means for being selectively coupled near the top of the means for extending forwardly including means for extending across the channel and through each of the two notches and means for abutting each of two internal surfaces of the channel, each of the two internal surfaces facing the other of the two internal surfaces and being adjacent a different one of the two notches, and means for extending downwardly from the means for abutting, through the channel, below the bottom of the means for extending forwardly, and to the merchandise display structure such that the merchandise display structure is suspended from the means for extending forwardly via the means for supporting the merchandise display structure.

* * * * *